US012584694B2

(12) United States Patent
Seeley

(10) Patent No.: US 12,584,694 B2
(45) Date of Patent: Mar. 24, 2026

(54) HEAT EXCHANGER

(71) Applicant: Edwards Limited, Burgess Hill (GB)

(72) Inventor: Andrew James Seeley, Clevedon (GB)

(73) Assignee: Edwards Limited, Burgess Hill (GB)

( * ) Notice: Subject to any disclaimer, the term of this patent is extended or adjusted under 35 U.S.C. 154(b) by 106 days.

(21) Appl. No.: 18/702,181

(22) PCT Filed: Nov. 17, 2022

(86) PCT No.: PCT/GB2022/052918
§ 371 (c)(1),
(2) Date: Apr. 17, 2024

(87) PCT Pub. No.: WO2023/089318
PCT Pub. Date: May 25, 2023

(65) Prior Publication Data

US 2025/0137728 A1 May 1, 2025

(30) Foreign Application Priority Data

Nov. 22, 2021 (GB) ..... 2116776

(51) Int. Cl.
*F28D 7/00* (2006.01)
*F28D 7/16* (2006.01)
(Continued)

(52) U.S. Cl.
CPC ..... *F28D 7/0008* (2013.01); *F28D 7/16* (2013.01); *F28F 1/025* (2013.01); *F28F 1/04* (2013.01); *F28F 7/02* (2013.01)

(58) Field of Classification Search
CPC ..... F28D 7/0008; F28D 7/0025; F28D 7/16; F28F 1/04; F28F 1/045; F28F 7/02
See application file for complete search history.

(56) References Cited

U.S. PATENT DOCUMENTS 4,101,287 A 7/1978 Sweed et al.
5,725,051 A * 3/1998 Veltkamp ..... F28F 9/02 165/165

(Continued)

FOREIGN PATENT DOCUMENTS

CN 102937385 A 2/2013
DE 1105894 B 5/1961

(Continued)

OTHER PUBLICATIONS

British Search Report dated May 16, 22 for corresponding British Application No. GB2116776.2, 2 pages.

(Continued)

*Primary Examiner* — Eric S Ruppert
*Assistant Examiner* — Hans R Weiland
(74) *Attorney, Agent, or Firm* — Theodore M. Magee; Westman, Champlin & Koehler, P.A.

(57) ABSTRACT

A heat exchanger is disclosed. The heat exchanger comprises a first set of first conduits for conveying a first fluid, first conduits having a triangular cross-section portion; and a second set of second conduits for conveying a second fluid, the second conduits having a triangular cross-section portion, wherein adjacent first conduits are interspaced by an intervening second conduit. In this way, the conduits may be located closely together with a space-efficient configuration which helps to improve the exchange of heat between the first and second fluids while also providing a compact arrangement which minimises the amount of material used to construct the heat exchanger.

5 Claims, 4 Drawing Sheets

(51) Int. Cl.

| | |
|---|---|
| ***F28F 1/02*** | (2006.01) |
| ***F28F 1/04*** | (2006.01) |
| ***F28F 7/02*** | (2006.01) |

(56) References Cited

U.S. PATENT DOCUMENTS

| | | | | |
|---|---|---|---|---|
| 10,317,095 | B2 * | 6/2019 | Dean | F28D 9/0025 |
| 2004/0261379 | A1 * | 12/2004 | Bruun | F28F 7/02 55/418 |
| 2019/0022806 | A1 | 1/2019 | Veilleux, Jr. et al. | |
| 2019/0033013 | A1 * | 1/2019 | Byfield | B22F 10/20 |
| 2019/0301808 | A1 * | 10/2019 | Holtzapple | B01D 1/305 |
| 2021/0003349 | A1 * | 1/2021 | Horoszczak | F28F 1/006 |
| 2021/0348856 | A1 * | 11/2021 | Fujiwara | F28D 7/08 |
| 2021/0381473 | A1 * | 12/2021 | Endou | F28F 1/025 |

FOREIGN PATENT DOCUMENTS

| | | | |
|---|---|---|---|
| GB | 2565143 | A | 2/2019 |
| JP | S54112376 | A | 9/1979 |
| WO | 03031050 | A1 | 4/2003 |
| WO | 03033985 | A1 | 4/2003 |
| WO | 2006029720 | A1 | 3/2006 |

OTHER PUBLICATIONS

PCT Notification of Transmittal of the International Search Report and the Written Opinion of the International Searching Authority, or the Declaration and PCT Search Report dated Feb. 13, 2023 for corresponding PCT application Serial No. PCT/GB2022/052918, 11 pages.

Japanese Notification of Reason for Rejection dated May 1, 2025 for corresponding Japanese application Serial No. 2024-530038, 6 pages.

* cited by examiner

HEAT EXCHANGER

CROSS-REFERENCE OF RELATED APPLICATION

This application is a Section 371 National Stage Application of International Application No. PCT/GB2022/052918, filed Nov. 17, 2022, and published as WO 2023/089318 A1 on May 25, 2023, the content of which is hereby incorporated by reference in its entirety and which claims priority of British Application No. 2116776.2, filed Nov. 22, 2021.

FIELD

The field of the invention relates to heat exchangers.

BACKGROUND

Heat exchangers are known. Heat exchangers typically take first fluid and a second fluid and convey those fluids through a structure to exchange heat between the first and second fluids. Although such heat exchangers exist, they each have their own shortcomings. Accordingly, it is desired to provide an improved heat exchanger.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided a heat exchanger, comprising:

a first set of first conduits for conveying a first fluid, first conduits having a triangular cross-section portion; and a second set of second conduits for conveying a second fluid, the second conduits having a triangular cross-section portion, wherein adjacent first conduits are interspaced by an intervening second conduit.

The first aspect recognises that a problem with existing heat exchangers is that they can be less efficient than desired, and that they can be larger and require more material in their construction than desired. Accordingly, a heat exchanger is provided. The heat exchanger may comprise a first set of conduits, channels or ducts. A first set of conduits may convey a first fluid. The first conduit may have a triangular cross-sectional portion. The heat exchanger may comprise a second set of conduits, channels or ducts. The second set of conduits may convey a second fluid. The second conduit may have a triangular cross-sectional portion. Adjacent first conduits may be interspaced, spaced-apart or offset by an intervening second conduit. In this way, the conduits may be located closely together with a space-efficient configuration which helps to improve the exchange of heat between the first and second fluids while also providing a compact arrangement which minimises the amount of material used to construct the heat exchanger.

The intervening second conduit may share a first common face with a first adjacent first conduit and the intervening second conduit may share a second common face with a second adjacent first conduit. In other words, a first face may define part of both one first conduit and the second conduit while another face may define both part of another first conduit and the second conduit.

The first conduits and the second conduits may be arranged in at least one tessellated row with alternating adjacent first and second conduits. This provides for a particularly compact arrangement which improves heat transfer between the first and second conduits and reduces the amount of material used for the heat exchanger.

Adjacent first and second conduits in each tessellated row may share two common vertices and a common face.

The heat exchanger may comprise a plurality of tessellated rows.

The first conduits and the second conduits in each tessellated row may be spatially aligned so that a vertex of each first conduit is positioned mid-way along a face of each first conduit in an adjacent row. Again, this provides for a particularly compact arrangement which improves heat transfer between the first and second conduits and reduces the amount of material used for the heat exchanger.

The first conduits and the second conduits in each tessellated row may be spatially aligned so that a vertex of each second conduit is positioned mid-way along a face of each second conduit in an adjacent row.

The first conduits and the second conduits in each tessellated row may be spatially aligned so that a face of each first conduit is shared with a second conduit in an adjacent row.

The first conduits and the second conduits in each tessellated row may be spatially aligned so that a face of each second conduit is shared with a first conduit in an adjacent row.

The first conduits and the second conduits in each tessellated row may be spatially aligned so that the second conduits are surrounded by four adjacent first conduits.

The first conduits and the second conduits in each tessellated row may be spatially aligned so that the first conduits are surrounded by four adjacent second conduits.

A first end of the first and second conduits may define a first aperture having a triangular cross-section.

The first and second conduits may have a narrowing portion towards a second end which defines a second aperture.

The first and second conduits may have the narrowing portion together with an adjacent enlarging portion towards the second end.

Each second aperture may be configured for fluid communication. In other words, the first or second fluids may pass through each second aperture.

Each second aperture may be positioned to define a common face through which fluid is conveyable.

The narrowing portion may transition from the triangular cross-section to a non-triangular cross-section. The transition may be a lofted transition.

The non-triangular cross-section may comprise a circular cross-section.

The adjacent enlarging portion may transition to a non-circular cross-section defining the second aperture. The transition may be a lofted transition.

The adjacent enlarging portion may transition to a square cross-section defining the second aperture. The transition may be a lofted transition.

Each square cross-section may be positioned in a tessellated pattern to define the common face through which a corresponding one of the first and second fluid is conveyable. This provides for a convenient structure through which the fluids are conveyable with the conduits.

The first set of the first conduits may extend in a first direction from the first end to the second end and the second set of the second conduits extend in a second direction from the first end to the second end, the second direction opposing the first direction. In other words, the first and second conduits may be aligned in opposing, counter-facing or differing orientations.

The first set of the first conduits may extend towards the second set of the second conduits so that the triangular cross-section portion of the first conduits nest with the triangular cross-section portion of the second conduits. In other words, the triangular cross-sections of some adjacent conduits may form the triangular cross-section of other conduits.

The narrowing portions of the second set of the second conduits may define a first void between outer surfaces of the narrowing portions and the first apertures of the first set of the first conduits are positioned for fluid communication with the first void for conveying the first fluid. In other words, the narrowing portions of the second conduits may provide a space within which the first fluid can be conveyed.

The narrowing portions of the first set of the first conduits may define a second void between outer surfaces of the narrowing portions and the first apertures of the second set of the second conduits are positioned for fluid communication with the second void for conveying the second fluid. In other words, the narrowing portions of the first conduits may provide a space within which the second fluid can be conveyed.

The heat exchanger may comprise a first housing portion enclosing the narrowing portions of the second set of the second conduits and defining a first port through which the first fluid is conveyable. In other words, the first housing portion together with the narrowing portions of the second set of the second conduits may define a plenum through which the first fluid can be conveyed between the first port and the first apertures of the first set of the first conduits.

The first housing portion may be in fluid communication with the first apertures of the first set of the first conduits for conveying the first fluid.

The first housing portion may extend at least between the triangular cross-section portion of the first set of the first conduits and the second aperture of the second set of the second conduits.

The first housing portion may enclose the first void.

The heat exchanger may comprise a second housing portion enclosing the narrowing portions of the first set of the first conduits and defining a second port through which the second fluid is conveyable. In other words, the second housing portion together with the narrowing portions of the first set of the first conduits may define a plenum through which the second fluid can be conveyed between the second port and the first apertures of the second set of the second conduits.

The second housing portion may be in fluid communication with the first apertures of the second set of the second conduits for conveying the second fluid.

The second housing portion may extend at least between the triangular cross-section portion of the second set of the second conduits and the second aperture of the first set of the first conduits.

The second housing portion may enclose the second void.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing embodiments in any more detail, first an overview will be provided. Some embodiments provide a heat exchanger. Typically, the heat exchanger is operated as a counter flow heat exchanger for exchanging heat between a first and a second fluid, although a common flow arrangement is also contemplated. The heat exchanger comprises a number of first conduits and a number of second conduits. The first conduits convey the first fluid and the second conduits convey the second fluid. At least a portion of those conduits have a triangular cross-section. The triangular cross-section portions are typically tessellated so that conduits carrying the first fluid are adjacent conduits carrying the second fluid. Typically, adjacent triangular portions share a common face to facilitate heat exchange between the first and second fluid. Such an arrangement provides a compact structure with improved contact surface area between the conduits, reduced material thickness between the conduits and a low thermal mass compared to some existing arrangements. Although a manifold arrangement is possible which can couple with each end of the first and second conduits to facilitate conveying the separate first and second fluids, an efficient arrangement envisages a narrowing one end of the first and second conduits which creates a space in fluid communication with an aperture at another end of the first and second conduits to enable the fluids to be conveyed. Typically, those spaces are enclosed by a respective housing which has an aperture or port through which the respective fluid is conveyed. By narrowing the conduits at opposing ends, two such housings can be provided to facilitate the conveying of the first and second fluids.

Heat Exchanger

Figure 1:
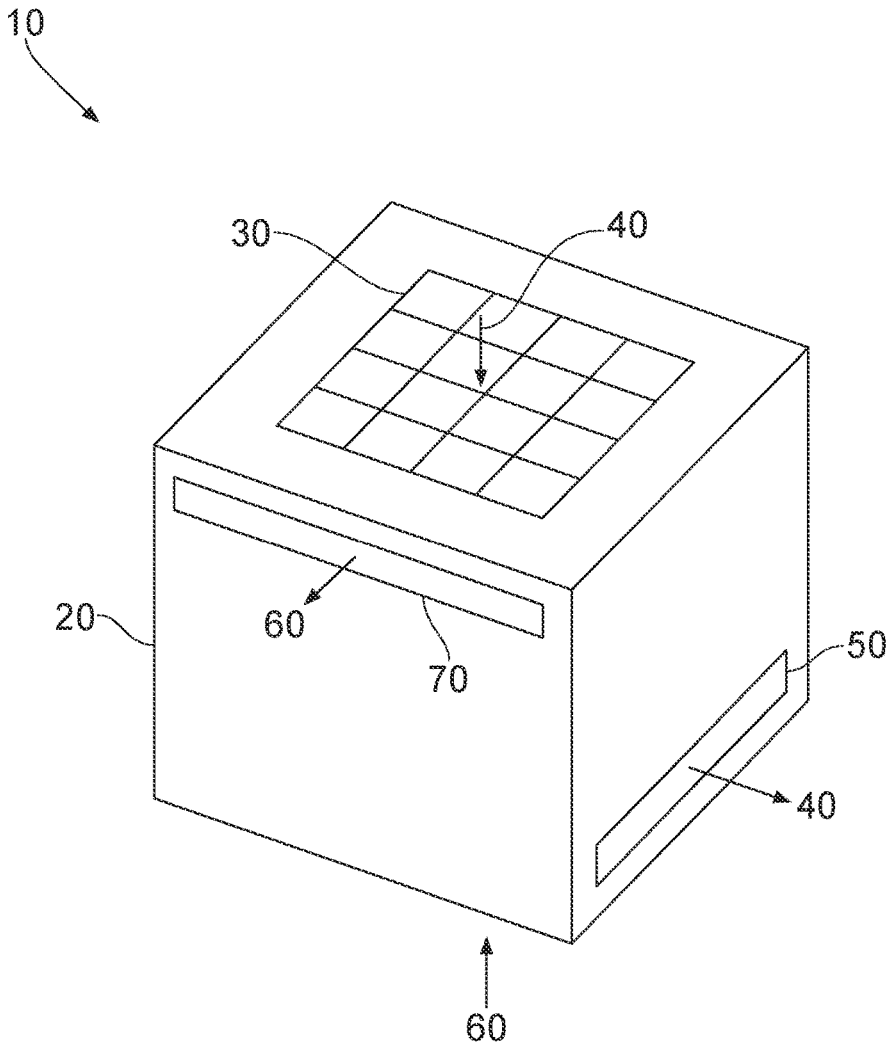
FIG. 1 illustrates schematically a heat exchanger according to one embodiment.

FIG. 1 illustrates schematically a heat exchanger 10 according to one embodiment. The heat exchanger 10 has a housing 20. In one face of the housing 20 is provided a set of second apertures 30 through which a first fluid 40 is conveyed. The housing 20 is provided with a port 50 on another face through which the first fluid is conveyed. Another set of second apertures (not shown) are provided on another face through which a second fluid 60 is conveyed. Another port 70 is provided on another face of the housing 20 through which the second fluid 60 is conveyed. Although the first fluid 40 is illustrated as flowing from the set of second apertures 30 to the first port 50 and the second fluid 60 is shown flowing from the set of second apertures (not shown) to the second port 70, it will be appreciated that the direction of the first fluid 40 and the second fluid 60 can be independently reversed that is to say that the heat exchanger 10 need not be operated as a counter flow heat exchanger as illustrated in FIG. 1 but may also be operated as a common flow heat exchanger.

Figure 2A:
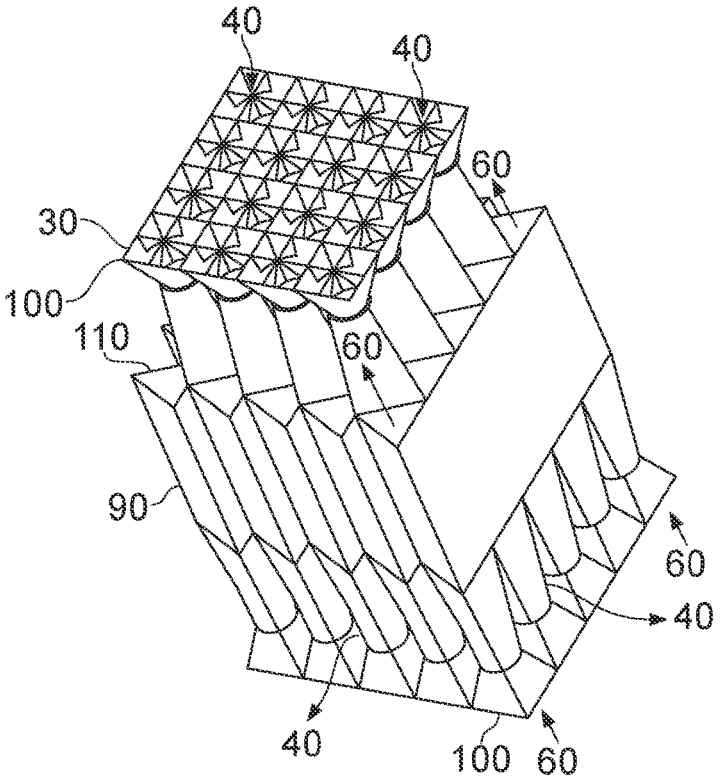
FIG. 2A illustrates the heat exchanger with the housing removed.
Figure 2B:
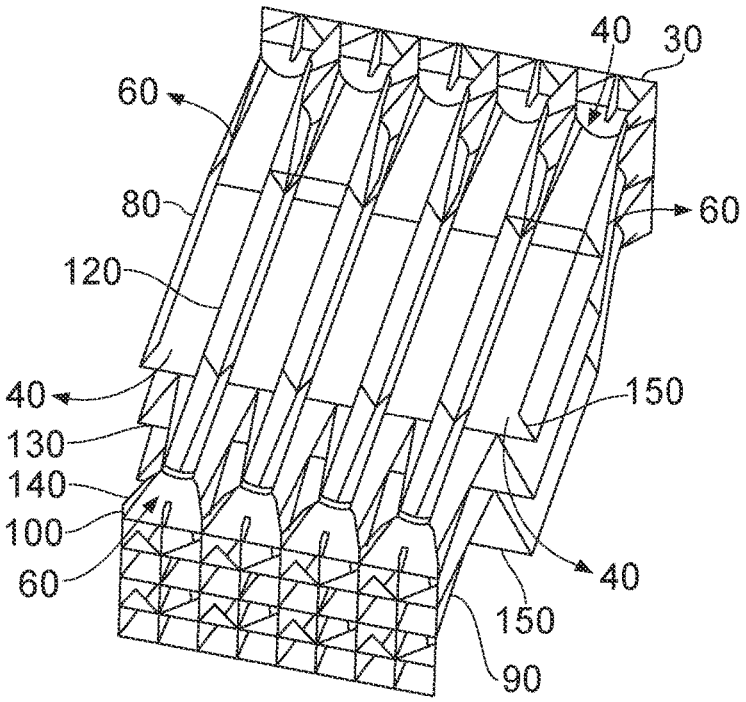
FIG. 2B is a cross-sectional view through the heat exchanger with the housing removed.

FIG. 2A illustrates the heat exchanger 10 with the housing 20 removed in order to show the internal configuration. FIG. 2B is a cross-sectional view through the heat exchanger 10 with the housing 20 removed. As can be seen, there is provided a set of first conduits 80 which nest with and extend into a set of second conduits 90.

Each first conduit 80 extends between its second aperture 30 and its first aperture 150 which terminates in a void between the second conduits 90. Each second conduit 90 extends between its second aperture 100 and its first aperture 110. As can be seen, the first apertures 110 are located in a void between the first conduits 80.

Figure 3A:
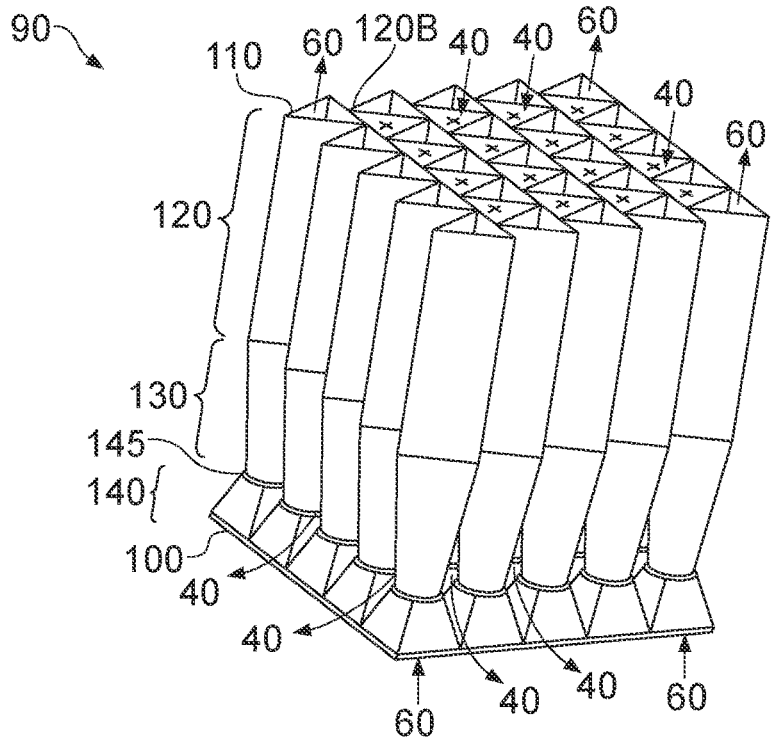
FIGS. 3A to 3D illustrates the configuration of the set of second conduits in more detail.
Figure 3B:
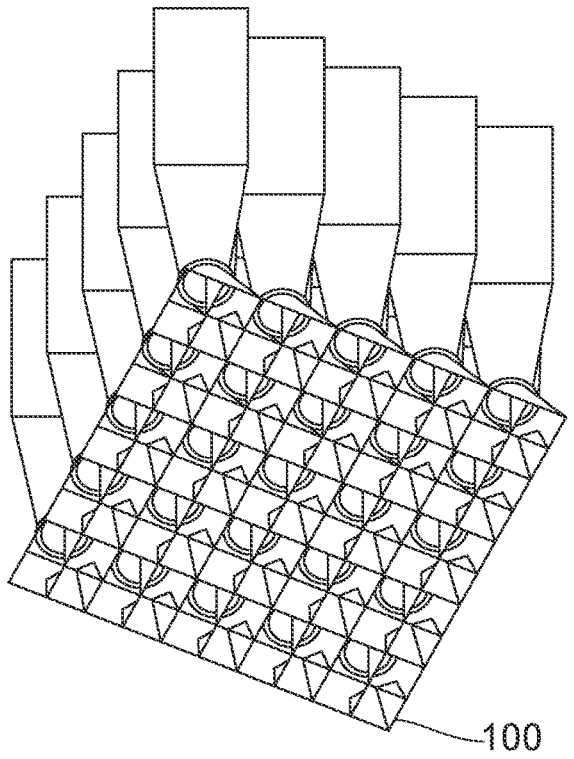
Figure 3C:
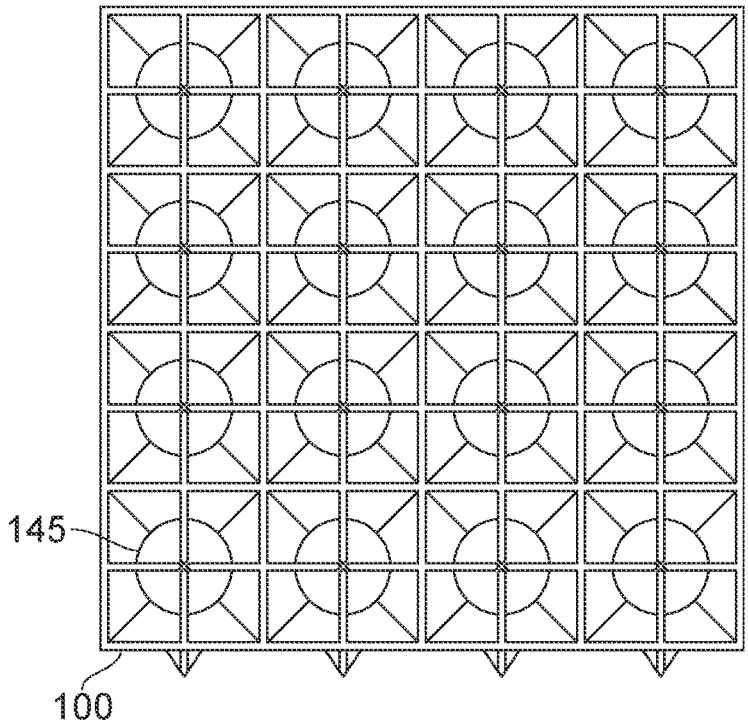
Figure 3D:
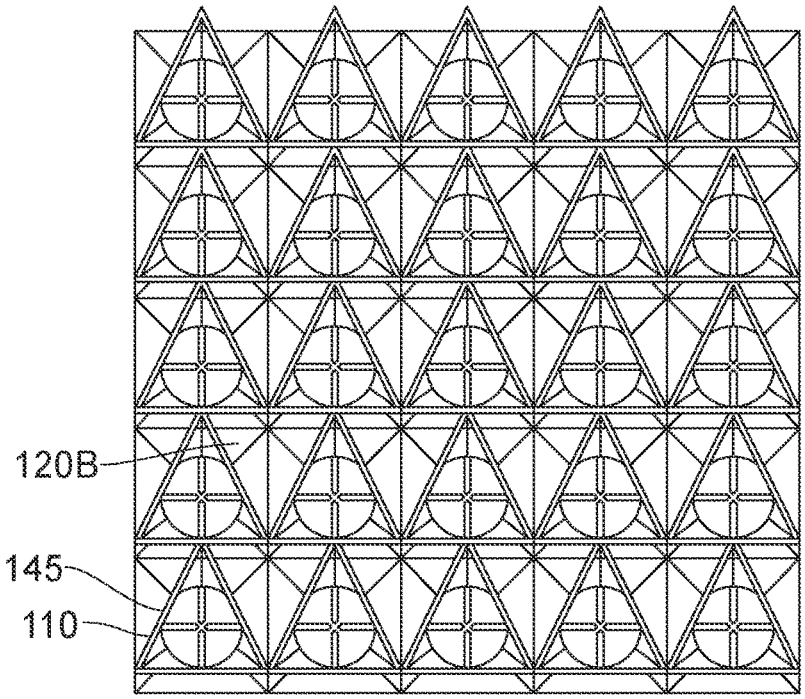

FIGS. 3A to 3D illustrates the configuration of the set of second conduits 90 in more detail. As can been seen from FIG. 2, the set of first conduits 80 have a similar configuration. FIG. 3A is a perspective top view, FIG. 3B is a perspective bottom view, FIG. 3C is a view looking towards the second apertures 110 and FIG. 3D is a view looking towards the first apertures 100.

As can be seen, each second conduit 90 extends between the first aperture 110 and the second aperture 100. The first aperture 110 has a triangular cross-section. The second conduit 90 has a triangular cross-section portion 120 which extends from the first aperture 110 along an elongate axis towards the second aperture 100. Adjacent the triangular cross-section portion 120 is a narrowing portion 130. The narrowing portion 130 reduces in cross-section or area towards the second apertures 100. As explained above, this creates a void which is in fluid communication with the first apertures 150 of the first conduits 80. Adjacent the narrowing portion 130 is an enlarging portion 140. The cross-section or area of the enlarging portion 140 increases towards the second apertures 100. The narrowing of the second conduits 90 provides a void which is in fluid communication with the first apertures 150 of the first conduits 80. The enlarging portion 140 enables the second apertures 100 to form a common face through which second fluid 60 can be conveyed. In this example, the narrowing portion 130 transitions from a triangular cross-section adjacent the triangular cross-section portion 120 to a circular cross-section 145 adjacent the enlarging portion 140. However, it will be appreciated that other cross-sectional shapes are possible. Also, the enlarging portion 140 transitions from a circular cross-section to a square cross-section at the second aperture 100. However, it will be appreciated that cross-sectional shapes other than squares can be provided. Having a square cross-sectional area is particularly convenient for the uniform arrangement of the second conduits 90, provides for a compact tessellated arrangement and helps to optimise the area through which the second fluid 60 is conveyed.

Referring now to FIGS. 2 and 3A, as can be seen, the triangular cross-section portions 120B of the first conduits 80 (one end of which is denoted by an x in FIG. 3A) are positioned between adjacent triangular cross-section portion 120B of the second conduits 90 in a series of tessellated rows. In fact, in this embodiment, the triangular cross-section portions 120B are defined by faces of adjacent triangular cross-section portions 120.

In operation, the first fluid 30 enters the first conduit 80 via the second apertures 30, passes through its enlarging portion, its narrowing portion, the triangular cross-section portion 120B and exits through its first aperture 150 into the void created by the narrowing portions 130 of the second conduit 90 and then through the first port 50. Meanwhile, the second fluid 60 enters the second conduits 90 via the second apertures 100, through the enlarging portion 140, the narrowing portion 130 and the triangular cross-section portion 120 and then exits via the first apertures 110 and into the void defined by the narrowing portions of the first conduits 80 and through the second port 70. This provides for a counterflow heat exchanger where the first and second fluid remained separated but which facilitates for heat exchange between the first and second fluids via the first and second conduits.

Some embodiments provide a high efficiency counter current heat exchanger designed for recovering heat from a catalytic reactor. The abatement of combustion by-products (e.g. NOx) can be performed over a catalyst, but this requires operation at elevated temperatures, thus heating may be required. The destruction reactions are often exothermic, so if heat can be recovered, a system can be self-sustaining. Such a heat exchanger of some embodiments would ideally be low mass/volume but high efficiency. Additive manufacturing techniques may be used to manufacture such a structure.

In some embodiments, the core of the heat exchanger comprises a nest of triangular passages formed between coincident walls. Each wall is a boundary between a forward flow and counter flow passage (or a hot flow and a cold flow). The passages typically have the same cross-sectional area. Hot passages are grouped together at their inlet and outlet, likewise cold passages are grouped together at their inlet and outlet. This grouping together is achieved by transitioning the triangular profile to a circular profile of reduced area then expanding to a square profile, such that the boundary walls of the individual square passages are coincident one with another. If this forms an outlet, then the inlet comprises an annular structure or belt surrounding the interstitial passages formed between the transitional features. These passages are orthogonal to the flow direction through the heat exchanger core. Increasing the height and/or reducing the diameter of the circular part of the transition improves the breathability of the structure.

A similar structure can be conceived with square passages, however calculations suggest the triangular arrangement has a higher heat transfer coefficient and is therefore more space-efficient. An upper grid face of the heat exchanger may act as the support for the catalyst bed. Depending on the relative size of the passages to the catalyst particles, additional structures may sub-divide the square outlet passages to form a grate, preventing the catalyst from entering the tubular heat exchange passages. As an example, a heat exchanger for use with a flow rate of around 600 slpm of gas comprising 4800 triangular passages on 2.5 mm pitch, 45 mm active length should be capable of exchanging around 5 KW of heat. This results in a 50° C. differential temperature. So if the temperature of gases exiting a catalyst bed is 450° C., then the temperature of the preheated gas presented to the catalyst would be 400° C.

In some embodiments, the triangular form gives compact geometry. In addition, the integrated grate gives support for the catalyst bed. The orthogonal passages cooperate with the intended form of a catalytic reactor to simplify its integration—minimal space/effort involved in ducting/connectivity.

It will be appreciated that it is possible to vary the pitch (area) of the passages, the height of the heat exchange element and the form of the transitions. Also, it is possible to use triangular, square or other cross-sectional shape passages.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A heat exchanger, comprising:

a first set of first conduits for conveying a first fluid, each first conduit comprising:

a triangular cross-section portion having a triangular opening, a narrowing triangular cross-section portion extending from the triangular cross-section portion, a first transition portion from the narrowing triangular cross-section portion to a circular cross-section portion, wherein the narrowing triangular cross-section portion has a smaller cross-sectional area at the first transition portion than at the triangular cross-section portion, a second transition portion extending from the circular cross-section portion to an enlarging square cross-section portion, and a square cross-section end portion at an end of the enlarging square cross-section portion;

wherein the square cross-section end portions of the first set of first conduits abut each other to form a first face; and a second set of second conduits for conveying a second fluid, each second conduit comprising:

a triangular cross-section portion having a triangular opening, a narrowing triangular cross-section portion extending from the triangular cross-section portion of the second conduit, a first transition portion extending from the narrowing triangular cross-section portion of the second conduit to a circular cross-section portion of the second conduit, wherein the narrowing triangular cross-section portion of the second conduit has a smaller cross-sectional area at the first transition portion of the second conduit than at the triangular cross-section portion of the second conduit, a second transition portion extending from the circular cross-section portion of the second conduit to an enlarging square cross-section portion of the second conduit, and a square cross-section end portion at an end of the enlarging square cross-section portion of the second conduit;

wherein the square cross-section end portions of the second set of first conduits abut each other to form a second face;

wherein the triangular cross-section portion of the first set of first conduits and the triangular cross-section portion of second set of second conduits form a plurality of tessellated rows formed of alternating adjacent first and second conduits;

wherein a first void is defined between outer surfaces of the narrowing triangular cross-section portions of the second set of second conduits and the triangular openings of the first set of first conduits are in fluid communication with the first void;

wherein a second void is defined between outer surfaces of the narrowing triangular cross-section portions of the first set of first conduits and the triangular openings of the second set of second conduits are in fluid communication with the second void.

2. The heat exchanger of claim 1, comprising a first housing portion enclosing said narrowing portions of said second set of said second conduits and defining a first port through which said first fluid is conveyable.

3. The heat exchanger of claim 2, wherein said first housing portion is in fluid communication with said triangular openings of said first set of said first conduits for conveying said first fluid and wherein said first housing portion encloses said first void.

4. The heat exchanger of claim 1, comprising a second housing portion enclosing said narrowing portions of said first set of said first conduits and defining a second port through which said second fluid is conveyable.

5. The heat exchanger of claim 4, wherein said second housing portion is in fluid communication with said triangular openings of said second set of said second conduits for conveying said second fluid and wherein said second housing portion encloses said second void.

* * * * *